US008002361B1

(12) United States Patent
Montano et al.

(10) Patent No.: US 8,002,361 B1
(45) Date of Patent: Aug. 23, 2011

(54) METHOD OF MANUFACTURING AND ASSEMBLING A DECORATIVE SKATE WHEEL

(76) Inventors: Manuel A. Montano, Torrance, CA (US); Henry K. Yu, Los Angeles, CA (US)

( * ) Notice: Subject to any disclaimer, the term of this patent is extended or adjusted under 35 U.S.C. 154(b) by 322 days.

(21) Appl. No.: 12/482,445

(22) Filed: Jun. 10, 2009

Related U.S. Application Data

(60) Provisional application No. 61/060,453, filed on Jun. 10, 2008.

(51) Int. Cl.
*A63C 17/22* (2006.01)

(52) U.S. Cl. ..... 301/5.307; 301/5.309; 301/5.7

(58) Field of Classification Search ..... 301/5.301, 301/5.7, 5.302, 5.303, 5.304, 5.305, 5.306, 301/5.307, 5.308, 5.309, 64.706; 152/323, 152/379.3; 280/11.19, 11.221, 11.27; 29/894.31
See application file for complete search history.

(56) References Cited

U.S. PATENT DOCUMENTS 674,577 A * 5/1901 Fowl ..... 301/5.307
1,803,019 A * 4/1931 Holm ..... 301/5.7
2,241,686 A 5/1941 Ware
2,276,570 A * 3/1942 Gaines ..... 301/5.7
2,432,105 A 12/1947 Wagner
2,552,987 A * 5/1951 Loertz, Jr. ..... 280/11.28
2,580,489 A 1/1952 Wagner
2,596,771 A * 5/1952 Harbour ..... 301/5.7
2,610,897 A 9/1952 Rebmann
2,701,740 A * 2/1955 Norman ..... 301/5.7
2,768,862 A * 10/1956 Christensen ..... 301/5.307
3,905,649 A 9/1975 Kosono et al.
4,114,952 A 9/1978 Kimmell
4,153,303 A * 5/1979 Tanner ..... 301/64.706
4,218,098 A 8/1980 Burton
4,879,794 A * 11/1989 Djerf ..... 29/894.31
4,881,732 A 11/1989 Kepiro
4,943,072 A 7/1990 Henig
5,308,152 A * 5/1994 Ho ..... 301/5.304
5,769,441 A 6/1998 Namngani
5,797,466 A 8/1998 Gendle
6,176,554 B1 * 1/2001 Huang ..... 301/5.7
6,237,923 B1 5/2001 Fowle
6,336,685 B1 1/2002 Orr
6,425,587 B1 7/2002 Moon
6,454,361 B1 9/2002 Martin
6,726,523 B2 4/2004 Baker
6,971,942 B2 12/2005 Baker

* cited by examiner

*Primary Examiner* — Kip T Kotter
(74) *Attorney, Agent, or Firm* — Law Office of David Hong

(57) ABSTRACT

There is an apparatus comprising a two-part hub system that can be used to make decorative wheel designs customizable, easier to assemble, and in a more cost effective way to manufacture. By splitting the hub into two parts, each individual hub part can be economically molded with simpler molds and be made from two separate processes; specifically, the first hub part could be made from a plastic injection molding process, and the second hub part could be made from a die-casting or plastic injection molding process combined with a vacuum metalizing process.

12 Claims, 8 Drawing Sheets

SECTION B-B

METHOD OF MANUFACTURING AND ASSEMBLING A DECORATIVE SKATE WHEEL

This application claims the benefit of U.S. Provisional Patent Appl. No. 61/060,453, filed on Jun. 10, 2008.

BACKGROUND OF THE INVENTION

1. Field of the Invention

This invention relates to the structure and the manufacture of skate and skateboard wheels with customizable non-metal, metal, metalized, or non-metalized decorative face designs.

2. Description of Related Art

Conventional skate wheels incorporated wheel face designs by molding the decorative face design into the visible face of the hub. This method did not allow the user to customize the design without purchasing a separate wheel.

Another method used decorative hub-caps, which were applied over the hub and fastened to the hub. This method made tightening the wheel nut more difficult as the user would have to first remove the hub-cap.

Another method mounted decorative hub-caps by mechanically fastening hub-caps to the outer tire surrounding the hub. This method was also more difficult to tighten the tires as the hub-cap would have to first be removed.

From the preceding descriptions, it is apparent that the devices currently being used have significant disadvantages. Thus, important aspects of the technology used in the field of invention remain amenable to useful refinement.

SUMMARY OF THE INVENTION

This invention relates to a two-part or multiple part hub system that can be used to make wheels and decorative wheel designs customizable, easier to assemble, and in a more cost effective way to manufacture.

This wheel apparatus and method of manufacturing have several aspects or facets that can be used independently, although they are preferably employed together to optimize their benefits. All of the foregoing operational principles and advantages of the present invention will be more fully appreciated upon consideration of the following detailed description, with reference to the appended drawings.

Figure 1:
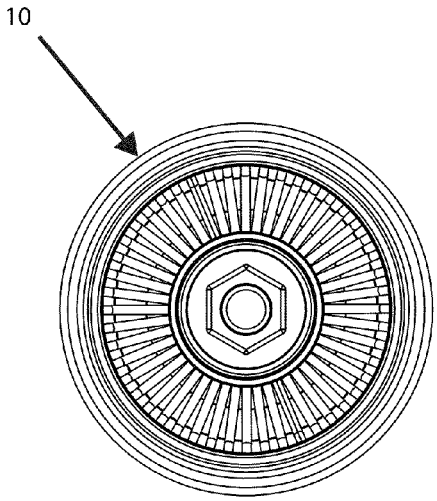
FIG. 1 shows the front plan view of one embodiment of the wheel.

The size indications are not intended to be limiting and are for example only.

PARTS LISTING

10 wheel
12 truck axle
14 bearing
16 first hub or inner hub
18 second hub or outer hub
20 nut
22 tire
24 holes or recessed structures on flange of 1st hub
26 thicker reinforced section on 1st hub (see FIG. 6)
28 flange or rim on 1st hub
30 keyed or toothed engagement area between the 1st and 2nd hubs

DESCRIPTION OF THE PREFERRED EMBODIMENTS

In FIG. 1, there is illustrated an assembly of a skate wheel 10.

Figure 2:
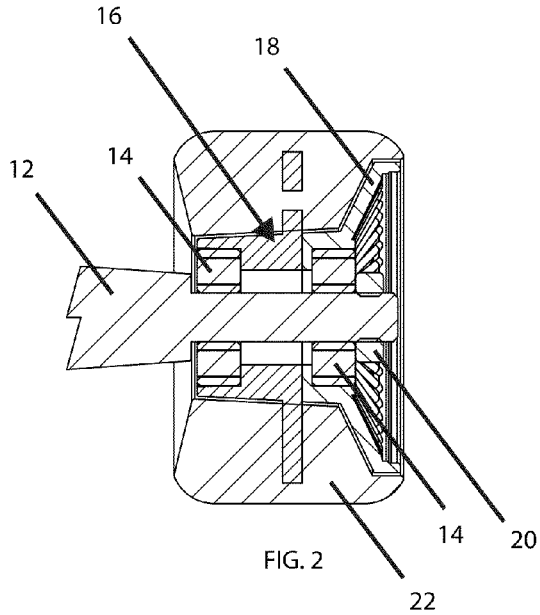
FIG. 2 shows the cross-sectional view of one embodiment of the wheel.

In FIG. 2, there is illustrated the components of the assembly. Starting from left to right, this assembly comprises the axle portion of a skate truck 12 or generic truck axle, which has a center axle member that telescopes and passes through the first bearing 14, the first hub 16 (inner hub), the tire 22, the second hub 18 (outer hub), the second bearing 14, and the fastening nut 20.

Figure 3:
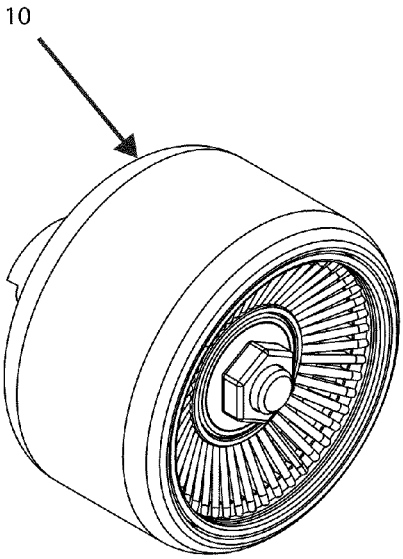
FIG. 3 shows the isometric view of one embodiment of the wheel.

In FIG. 3, there is illustrated an isometric view showing the assembly 10.

Figure 4:
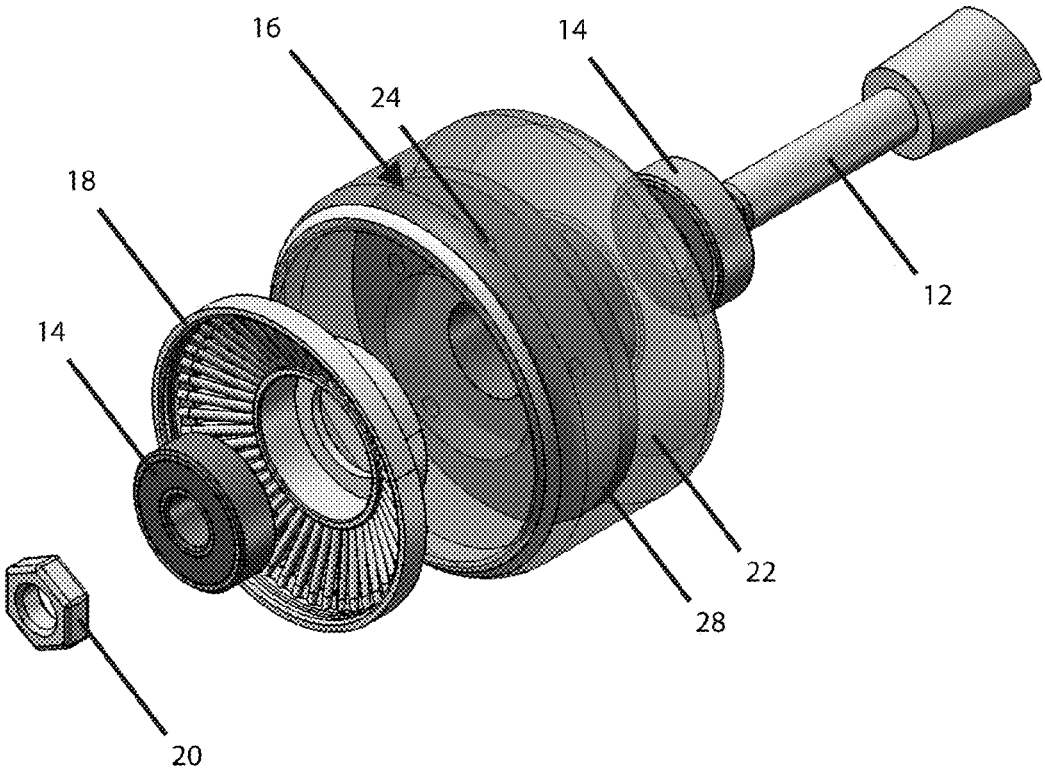
FIG. 4 shows the exploded isometric view of one embodiment of the wheel.

In FIG. 4, there is illustrated an isometric exploded view showing the assembly, wherein the axle 12 of the truck receives and engages the first bearing 14. The first hub 16 comprises: two sides (first and second sides); a structure with minimal undercuts or holes 24 for mold-ability; and a centrally located through-hole that penetrates through the center of the first and second side to receive or engage the truck axle.

The first hub 16 on the first side comprises a receptacle or space to receive the first bearing 14. The first hub 16 on the second side comprises a flange, a flanged structure or a rim 28 that incorporates at least one through-hole 24 and/or one recessed structure or indentation and/or one protruding structure (such as stalks or engaging appendages) to receive a co-molded bond with the tire 22. The flanged structure 28 of the first hub 16 also creates a structural point of interference with the second hub 18. The flange or rim can have a diameter wider than the width of the axle or the bearing or even the second or outer hub.

The tire 22 comprises two sides and a through-hole that penetrates through the center of the first side and second side. The first side of the tire 22 comprises a co-molded mate with the tire and the first side of the first hub 16. The second side of the tire 22 comprises a female receptacle or space that receives the second hub 18.

The second hub 18 comprises: two sides (first and second sides of the second hub); a structure with minimal undercuts for mold-ability; and a through-hole that penetrates through the center of the first and second side. The first side of the second hub 18 comprises a male end, which mates with the second side of the tire 22 and interferes with the second side of the first hub 16.

The mating of the first side of the second hub 18 and the second side of the tire 22 can comprise keying or toothed elements on the surface of the male and female structures (see FIGS. 9, 12, 14, 17). The second side of the second hub 18 comprises a receptacle to receive the second bearing 14. Surrounding the receptacle on the second side of the second hub 18, there is a molded decorative wheel design that comprises or does not comprise the through-holes.

The second bearing 14 is inserted into the receptacle of the second side of the second hub 18. A fastening nut 20 or securing device is screwed on or fastened onto the axle 12 end of the truck to lock the assembly together. Other threaded or non-threaded securing devices can be used.

Figure 5:
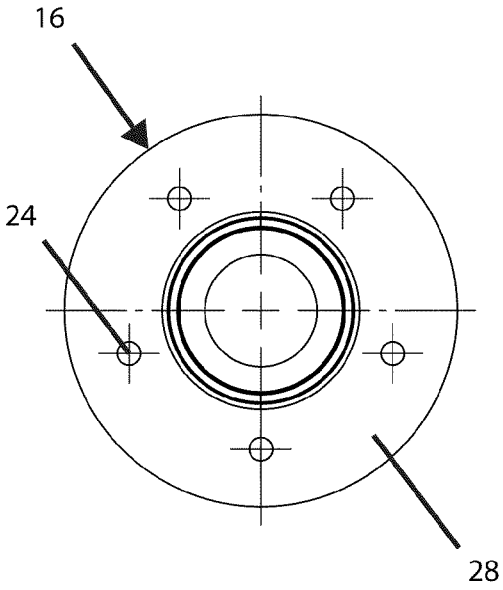
FIG. 5 shows the plan view of hub part A of one embodiment of the wheel.

In FIG. 5, there is illustrated the second side of the first hub 16 that comprises a flanged structure 28 that incorporates at least one through-hole or opening 24, and/or one recessed structure, and/or one protruding structure to receive a co-molded bond with the tire 22.

Figure 6:
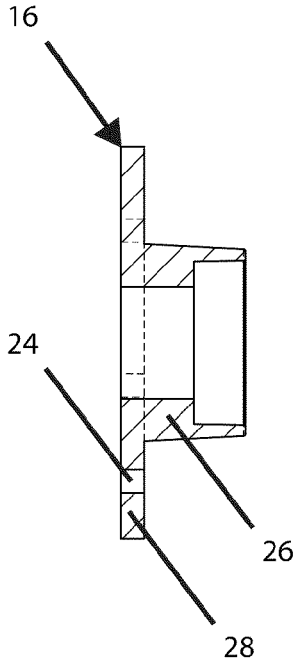
FIG. 6 shows the cross-sectional view of hub part A of one embodiment of the wheel.

In FIG. 6, there is illustrated the split side view of the first hub 16 that comprises a thicker reinforced section 26, which creates increased strength to the wheel assembly 10.

Figure 7:
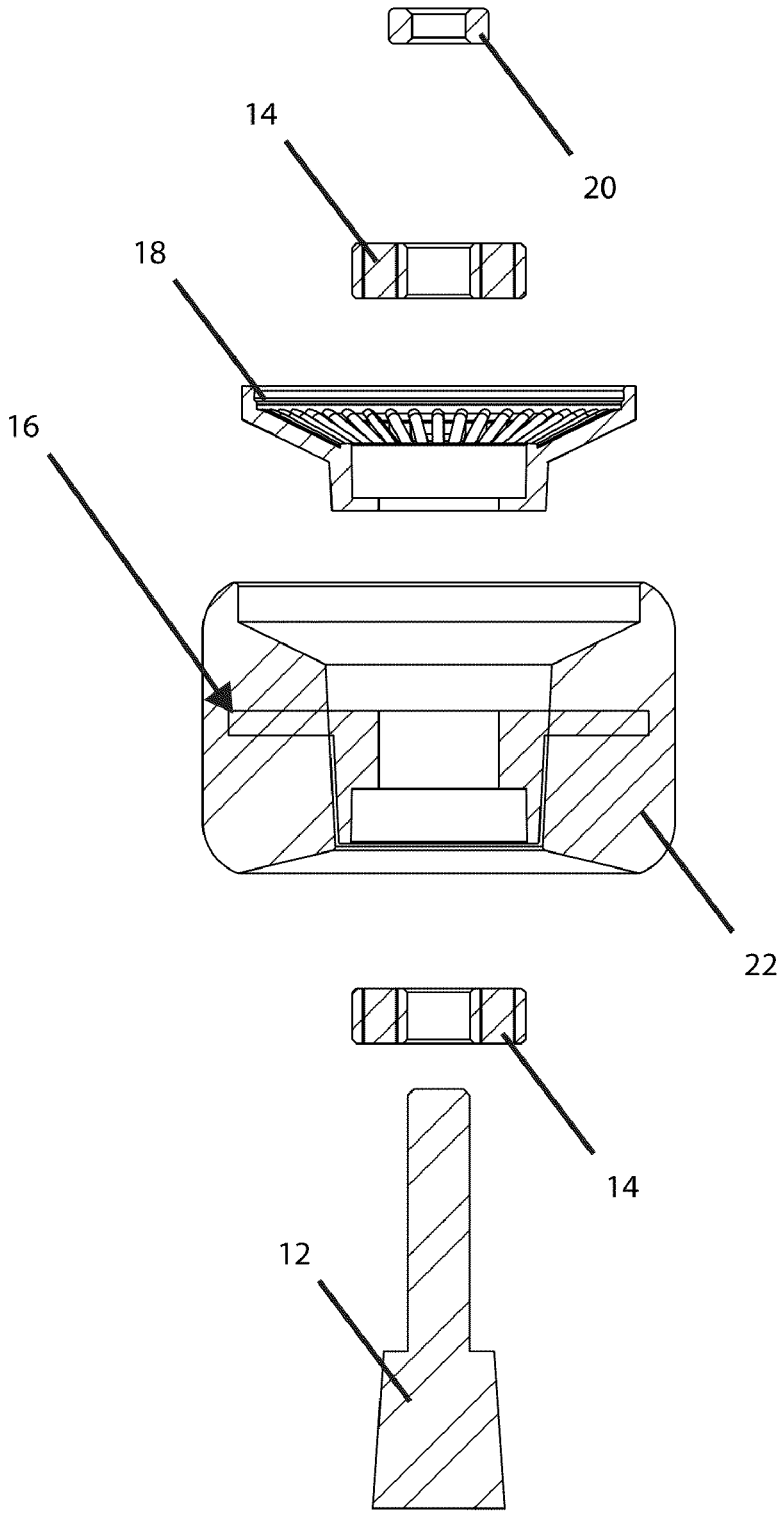
FIG. 7 shows the exploded cross-sectional view of one embodiment of the wheel.
Figure 9:
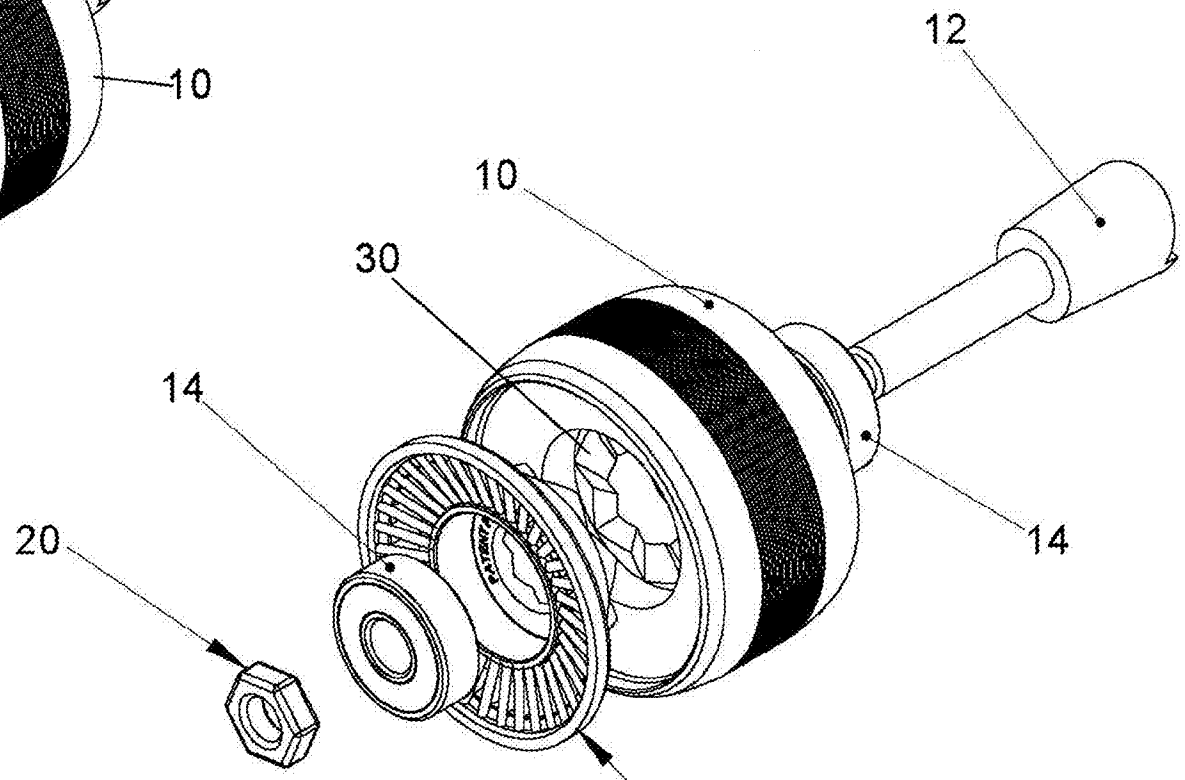
FIG. 9 shows an exploded isometric view of another embodiment of the wheel (52 mm version) and shows the teethed connection between the hubs.
Figure 8:
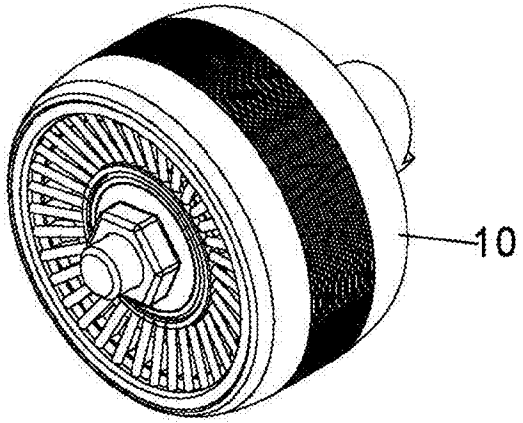
FIG. 8 shows an isometric view of one embodiment of the wheel (52 mm version).
Figure 12:
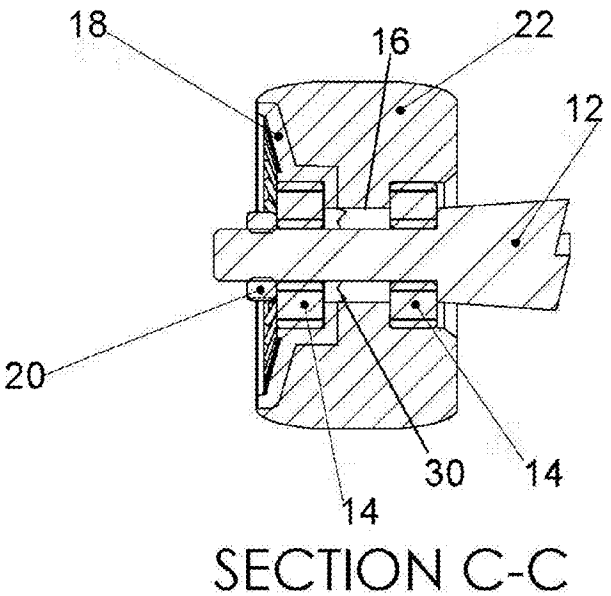
FIG. 12 shows a cross-sectional view of one embodiment of the wheel (52 mm version) and shows the teeth connection between the hubs.
Figure 10:
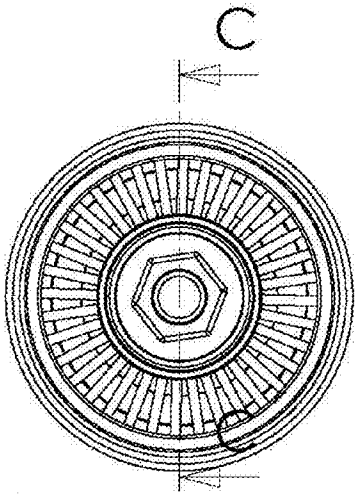
FIG. 10 is a front plan view of one embodiment of the wheel (52 mm version).
Figure 11:
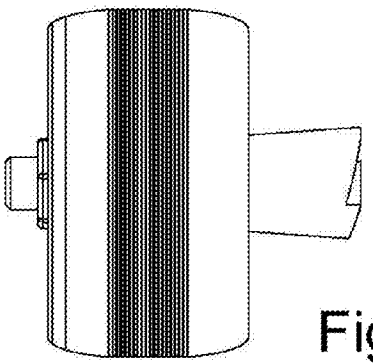
FIG. 11 is a side view of one embodiment of the wheel (52 mm version).
Figure 13:
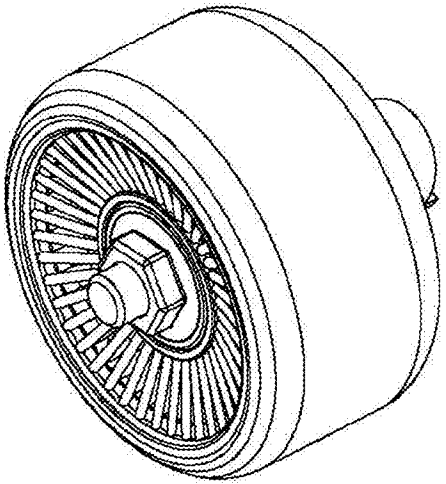
FIG. 13 shows an isometric view of one embodiment of the wheel (60 mm version).
Figure 14:
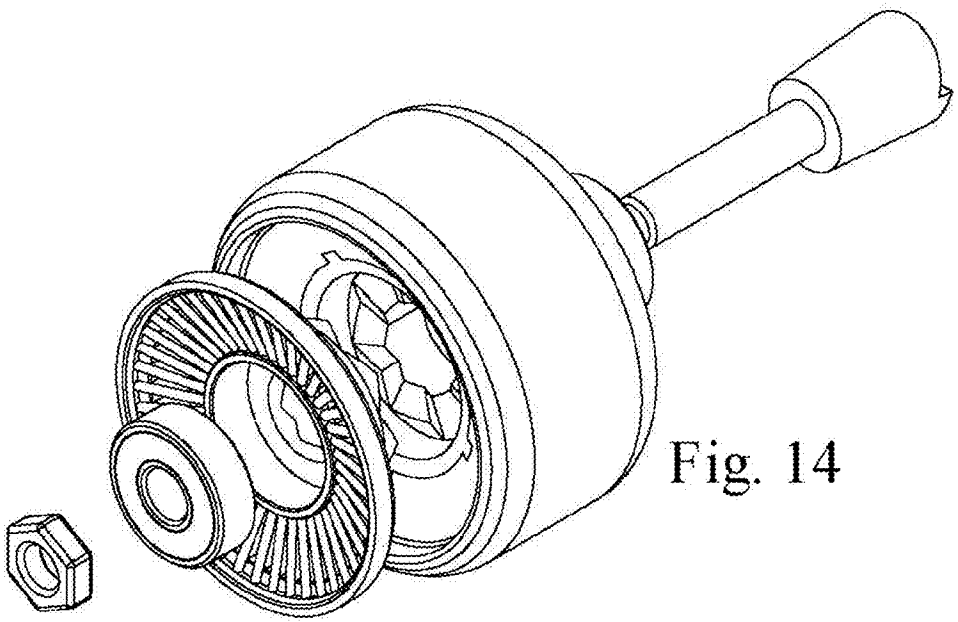
FIG. 14 shows an exploded isometric view of one embodiment of the wheel (60 mm version).
Figure 17:
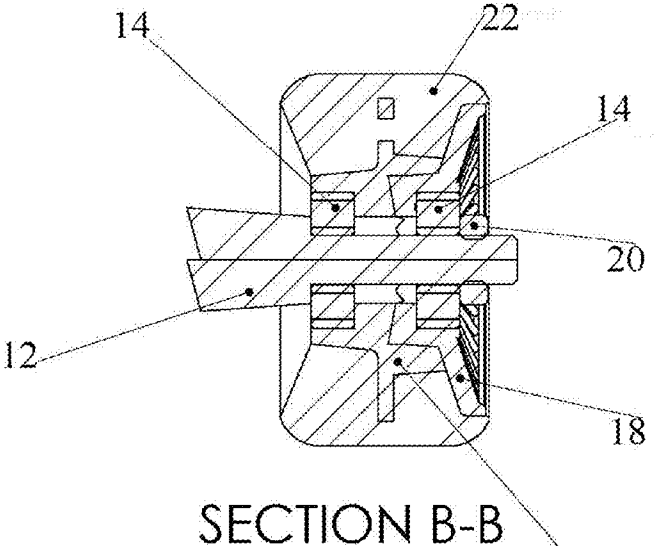
FIG. 17 shows the cross-sectional view of one embodiment of the wheel (60 mm version).
Figure 15:
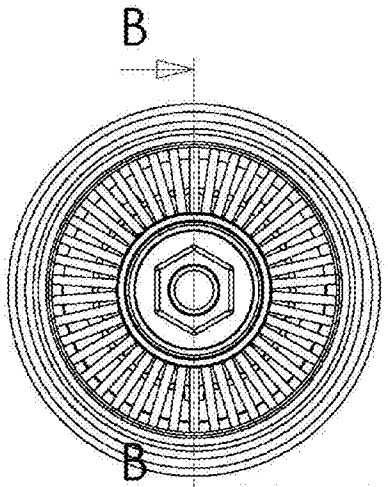
FIG. 15 shows a front plan view of one embodiment of the wheel (60 mm version).
Figure 16:
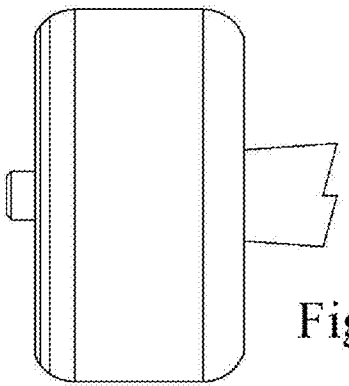
FIG. 16 shows a side view of one embodiment of the wheel (60 mm version).

In FIG. 7, there is illustrated the exploded view of the wheel assembly 10.

Manufacturing Techniques:

Traditionally, to mount or to put a rim onto a skate tire, a single hub would be used with a wheel design, and an elastomer or elastomeric material would be molded around this part. The present manufacturing method is significantly different because there is a modular system, which makes it possible to lower the cost of manufacturing, as well as make the wheel design interchangeable.

A load bearing hub consists of two sides. The first side of the hub comprises a receptacle for inserting a bearing. The second side of the hub comprises a thick ring construction for load bearing purposes. Surrounding this load bearing section is a flange with perforations or holes.

An elastomer wheel or tire body is co-molded around and into the inner hub, where one side of the wheel is flush to the hub. The opposite side of the wheel is molded with a receptacle to receive a second hub. The outer or second hub has a male connection to insert into the tire molded around the first hub. The second side comprises a receptacle to receive a second bearing. Surrounding the receptacle on the hub is a wheel design. All parts are sandwiched in between a truck axle and a fastening nut.

This structure and manufacturing technique employ two hubs in the wheel assembly, which provide the following advantages:

(1) Co-mold elastomer around the first hub without worrying about temperature complications and or precision of mold design;

(2) To create a standard wheel mold (i.e. tire molded around the first or inner hub) and a separate wheel design mold (i.e. second or outer hub)—this separation of the molds is more economical during manufacturing and allows for a greater range of treatments for the outer hub.

(3) We can make the second hub from a variety of manufacturing processes, such as diecasting or injection molding with vacuum metalizing, and we do not have to worry about compatibility of processes such as co-molding with vacuum metalized parts.

This manufacturing process avoids complications of introducing metalized parts during the molding process and avoids having to introduce heat and liquids, which could damage the coatings and the metalized parts.

There is an apparatus for a wheel comprising: an axle; an inner hub removably connected to an outer hub; a first bearing and a second bearing; the inner hub has a first inner hub side and a second inner hub side; the first inner hub side engages the first bearing; the second inner hub side has a flange; the flange extends beyond a diameter of the bearings; a tire is molded around the flange of the inner hub; the outer hub engages the second bearing; a nut secures the first and the second bearings and the inner and the outer hubs against the axle; the flange has at least one hole or indentation for engaging the tire; the inner hub removably connects to the outer hub using a keying or a teethed connection.

The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language). The term coupled, as used herein, is defined as connected, although not necessarily directly, and not necessarily mechanically.

Although specific embodiments of the invention have been disclosed, those having ordinary skill in the art will understand that changes can be made to the specific embodiments without departing from the spirit and scope of the invention. The scope of the invention is not to be restricted, therefore, to the specific embodiments, and it is intended that the appended claims cover any and all such applications, modifications, and embodiments within the scope of the present invention.

Any element in a claim that does not explicitly state "means for" performing a specific function, or "step for" performing a specific function, is not be interpreted as a "means" or "step" clause as specified in 35 U.S.C. Sec. 112, Paragraph 6. In particular, the use of "step of" in the claims herein is not intended to invoke the provisions of 35 U.S.C. Sec. 112, Paragraph 6.

We claim:

1. An apparatus for a wheel comprising:
an axle;
an inner hub removably connected to an outer hub;
a first bearing and a second bearing;
the inner hub has a first inner hub side and a second inner hub side;
the first inner hub side engages the first bearing;
the second inner hub side has a flange;
the flange extends beyond a diameter of the bearings;
a tire is molded around the flange of the inner hub;
the outer hub engages the second bearing; and
a nut secures the first and the second bearings and the inner and the outer hubs against the axle.

2. The apparatus for a wheel in claim 1 wherein the flange has at least one hole for engaging the tire.

3. The apparatus for a wheel in claim 1 wherein the flange has at least one indentation for engaging the tire.

4. The apparatus for a wheel in claim 1 wherein the inner hub removably connects to the outer hub using a keying or a teethed connection.

5. An apparatus for a wheel comprising:

an axle;

an inner hub removably connected to an outer hub;

a first bearing and a second bearing;

the inner hub has a first inner hub side and a second inner hub side;

the first inner hub side engages the first bearing;

the second inner hub side has a flange;

the flange has at least one hole;

a tire is molded around the flange of the inner hub;

the outer hub engages the second bearing; and a nut secures the first and the second bearings and the inner and the outer hubs against the axle.

6. The apparatus for a wheel in claim 5 wherein the flange has at least one indentation for engaging the tire.

7. The apparatus for a wheel in claim 5 wherein the inner hub removably connects to the outer hub using a keying or a teethed connection.

8. The apparatus for a wheel in claim 5 wherein the flange extends beyond a diameter of the bearings.

9. An apparatus for a wheel comprising:

an axle;

an inner hub removably connected to an outer hub;

a first bearing and a second bearing;

the inner hub has a first inner hub side and a second inner hub side;

the first inner hub side engages the first bearing;

the second inner hub side has a rim;

the rim extends beyond a diameter of the bearings;

a tire is molded around the rim of the inner hub;

the outer hub engages the second bearing; and a nut secures the first and the second bearings and the inner and the outer hubs against the axle.

10. The apparatus for a wheel in claim 9 wherein the rim has at least one hole for engaging the tire.

11. The apparatus for a wheel in claim 9 wherein the rim has at least one indentation for engaging the tire.

12. The apparatus for a wheel in claim 9 wherein the inner hub removably connects to the outer hub using a keying or a teethed connection.

* * * * *